US005787699A

United States Patent [19]

Morishita et al.

[11] Patent Number: 5,787,699

[45] Date of Patent: Aug. 4, 1998

[54] THREAD PIECING METHOD FOR ROTOR TYPE OPEN END SPINNING FRAME AND APPARATUS THEREFOR

[75] Inventors: Toshio Morishita; Atsuo Sakakibara, both of Kariya, Japan

[73] Assignee: Kabushiki Kaisha Toyoda Jidoshokki Seisakusho, Kariya, Japan

[21] Appl. No.: 677,954

[22] Filed: Jul. 10, 1996

[30] Foreign Application Priority Data

Jul. 11, 1995 [JP] Japan ..... 7-175157

[51] Int. Cl.[6] ..... D01H 13/26

[52] U.S. Cl. ..... 57/263; 57/404; 57/408; 57/417

[58] Field of Search ..... 57/263, 404, 408, 57/417

[56] References Cited

U.S. PATENT DOCUMENTS

| | | | |
|---|---|---|---|
| 4,044,537 | 8/1977 | Negishi et al. | 57/417 |
| 4,825,631 | 5/1989 | Raasch | 57/263 |
| 5,359,846 | 11/1994 | Miyamoto et al. | 57/417 |
| 5,406,783 | 4/1995 | Kaneko et al. | 57/263 |
| 5,540,044 | 7/1996 | Raasch | 57/416 |

FOREIGN PATENT DOCUMENTS

| | | | |
|---|---|---|---|
| 585824 | 3/1994 | European Pat. Off. . | |
| 1932009 | 1/1970 | Germany . | |
| 3247288 | 6/1983 | Germany . | |
| 533226 | 2/1993 | Japan . | |
| 5-86512 | 4/1993 | Japan | 57/417 |
| 6-123020 | 5/1994 | Japan | 57/263 |
| 6123020 | 5/1994 | Japan . | |

*Primary Examiner*—William Stryjewski

*Attorney, Agent, or Firm*—Brooks Haidt Haffner & Delahunty

[57] ABSTRACT

An inner rotor 5 has a recess 7 formed at a position corresponding to a navel 6 and the recess 7 has a taper surface 7*a* formed to the peripheral edge thereof. The end surface 6*c* of the navel 6 can be moved together with a support member 12 to an ordinary spinning position where it can be engaged with a thread Y drawn out through a thread guide and to a thread piecing position where it cannot be engaged therewith. When the thread is pieced, the navel 6 is disposed at the thread piecing position and after a seed thread is introduced into an outer rotor 2 from a thread drawing-out path 6*b* in the state that both the rotors 2, 5 are rotated, a fiber bundle in a fiber collecting portion 2*a* is drawn out together with the seed thread and a thread is spun without passing through the thread guide. Thereafter, the navel 6 is moved to the ordinary spinning position. While the navel 6 is being moved, the end surface 6*c* thereof is engaged with the thread Y which is introduced into the thread guide opened on the opening side of the outer rotor 2, so that operation proceeds to ordinary spinning. With this arrangement, the extreme end of the seed thread is caused to securely reach up to the fiber bundling unit of the outer rotor in thread piecing, whereby a spinning state in the thread piecing can smoothly proceed to the ordinary spinning state.

31 Claims, 9 Drawing Sheets

THREAD PIECING METHOD FOR ROTOR TYPE OPEN END SPINNING FRAME AND APPARATUS THEREFOR

BACKGROUND OF THE INVENTION

1. The Field of the Invention

The present invention relates to a thread piecing method in a rotor type open end spinning frame and an apparatus therefor by which a thread is pieced in such a manner that an inner rotor, which includes a thread guide for guiding a thread drawn out from a fiber collecting portion to the end of a thread drawing-out path, is disposed coaxially in an outer rotor, which outer rotor includes a fiber collecting portion in which fibers fed in a separated state are collected and bundled. The outer rotor and the inner rotor are positively driven independently. A navel disposed at the end of the thread drawing-out path is moved nearer to the opening side of the outer rotor as compared to an ordinary spinning position when the thread is pieced. Thereafter the navel is returned to the ordinary spinning position.

2. Prior Art

In general, in a rotor type open end spinning frame, sliver being fed is made to the state that fibers are separated from each other by a combing roller to remove impurities and the thus scatteringly separated fibers are transported into a rotor rotating at a high speed by an air flow generated in a fiber transportation path (fiber transportation channel) based on a negative pressure in the rotor. Then, the fibers transported into the rotor are bundled in a fiber collecting portion or groove as the maximum inside diameter portion of the rotor, drawn out from a guide hole (thread drawing-out path) disposed at the center of the navel by the action of a drawing-out roller and simultaneously twisted to a thread by the rotation of the rotor and wound around a bobbin as a package.

The open end spinning frame has good productivity as compared with that of a ring spinning frame. However, the fiber bundle bundled in the fiber collecting portion is only adhered to the inner wall of the fiber collecting portion by the action of a centrifugal force caused by the rotation of the rotor. Therefore, the twist applied to the fiber bundle (thread) drawn along the guide hole is also transmitted to the fiber bundle upwardly of the point where the fiber bundle is taken off to some degree. As a result, since the fibers are twisted in the state that they are not sufficiently extended without being provided with sufficient tension, the fibers are not twisted straight, thus there is a problem that the thread is not made strong. Further, there is a drawback that fibers without a restraint force which slides toward the fiber collecting portion along the inner wall of the rotor are coiled around the fiber bundle in rotation and disturbs the outside appearance of the thread and when the threads are made into a fabric, its feeling is made bad. Further, a problem also-arises in that fibers fed into the rotor from the fiber transportation path are coiled around the fiber bundle which is in a way from the fiber collecting portion to a thread drawing-out path and being twisted and disturb its outside appearance.

There is proposed an apparatus comprising an inner rotor disposed in an outer rotor having a fiber collecting portion, the inner rotor being provided with a thread guide for drawing out a fiber bundle bundled in the fiber collecting as well as positively driven independently of the outer rotor (for example, Japanese Unexamined Patent Publication No. 6-123020) as an apparatus for overcoming the drawback of the conventional open end thread. The Publication also discloses a thread piecing method of introducing a thread to the thread guide making use of the movement of a navel which has a thread drawing-out path formed thereto and is disposed so that the end surface thereof can move between a spinning position where the end surface can be engaged with a thread being spun through the thread guide and an evacuating position where the end surface cannot be engaged with the thread. According to this method, a thread introduction path communicating with the thread guide is disposed to the inner rotor as well as when a thread is pieced, the extreme end of a seed thread is introduced into the fiber collecting portion of the outer rotor through the thread introduction path from the thread drawing-out path in the state that the navel is located at the evacuating position. After the extreme end of the seed thread reaches the fiber collecting portion, the seed thread is drawn out together with the fiber bundle and then the navel is moved to the spinning position to permit the fiber bundle to be introduced into the thread guide.

Further, as shown in FIG. 14 of the present application, which corresponds to FIG. 35 of the above Publication, there is also proposed an apparatus arranged such that an inner rotor 62 is disposed nearer to the bottom side of an outer rotor 61 as compared with a plane including the fiber collecting portion 61*a* of an outer rotor 61 and a fiber bundle bundled in the fiber collecting portion 61*a* is guided to the thread drawing-out path of a navel 65 through a roller 64 disposed to the thread guide 63 of the inner rotor 62 at the end thereof on the outer rotor side thereof. In this apparatus, a thread is pieced by disposing the navel 65 at a position where the end thereof is located on the plane including the fiber collecting portion 61*a* see FIG. 36 of the above publication, and the navel 65 is disposed at a position shown in present FIG. 14 in ordinary spinning operation.

However, in the apparatus employing the former thread piecing apparatus, since the thread guide 63 and the thread introduction path 67 formed to the inner rotor 62 are relatively narrow as shown in FIG. 15 of the present application, it is difficult for the extreme end of the seed thread inserted from the thread drawing-out path into the thread introduction path 67 to reach the fiber collecting portion in the thread piecing. On the other hand, in the latter apparatus, the seed thread introduced from the thread drawing-out path 66 can easily reach the fiber collecting portion 61*a* because there is no obstacle between the end surface of the navel 65 and the fiber collecting portion 61*a* in the thread piecing. However, there is a problem that since the thread guide 63 has a narrow width, when a spinning state in the thread piecing is transferred to an ordinary spinning state, it is difficult to smoothly introduce a thread being spun into the thread guide 63.

SUMMARY OF THE INVENTION

An object of the present invention made taking the above problems into consideration is to provide a method and apparatus of a rotor type open end spinning frame capable of causing the extreme end of a seed thread to securely reach up to the fiber collecting portion of an outer rotor in thread piecing as well as transferring a spinning state in the thread piecing to an ordinary spinning state.

According to a first aspect of the present invention for solving the above problem, there is provided a thread piecing method in an open end spinning frame having an outer rotor which includes a fiber collecting portion to which fibers fed in a separated state are bundled and an inner rotor which includes a thread guide for guiding a thread drawn out from the fiber collecting portion to the end of a thread drawing-out path and is disposed in the outer rotor coaxially therewith wherein the inner rotor is positively driven independently of the outer rotor to piece the thread by moving a navel disposed at the end of the thread drawing-out path nearer to the opening side of the outer rotor as compared with an ordinary spinning position when the thread is pieced and thereafter the navel is returned to the ordinary spinning position, the method comprising the steps of moving the navel to a thread piecing position when the thread is pieced, introducing a seed thread from the thread drawing-out path into the outer rotor in the state that the outer rotor is rotated, causing the extreme end of the seed thread to reach a position where it comes into contact with a fiber bundle in the fiber collecting portion, drawing the fiber bundle in the fiber collecting portion together with the seed thread from the thread drawing-out path without causing them to pass through the thread guide of the inner rotor and spinning them after the extreme end of the seed thread reaches the position, moving the navel to the ordinary spinning position side thereafter, introducing a thread into the thread guide by rear guide surfaces located nearer to an outer rotor drive unit side as compared with a guide surface disposed on a wall surface across the thread guide forward of a thread rollingly moving direction, and proceeding to ordinary spinning while holding the navel at the ordinary spinning position.

The separated fibers fed into the outer rotor from the fiber transportation path slide along the inner wall surface of the outer rotor and are bundled to the fiber collecting portion. The fiber bundle bundled in the fiber collecting portion is taken off therefrom and drawn out as a thread while being twisted through the inner rotor. The navel is moved to the thread piecing position in thread piecing and the extreme end of the seed thread is introduced into the outer rotor from the thread drawing-out path in the state that the outer rotor is rotated and securely reaches the fiber collecting portion. After the extreme end of the seed thread reaches a position where it comes into contact with the fiber bundle in the fiber collecting portion, the fiber bundle in the fiber collecting portion is drawn out together with the seed thread and a thread is spun without passing through the thread guide of the inner rotor. Thereafter, the navel is moved to the side of the ordinary spinning position as well as the end of the navel is engaged with the thread being spun while the navel is being moved, and when the navel is further moved to the ordinary spinning position side, the above thread is introduced into the thread guide opened to the opening side of the outer rotor. Then, the navel is held at the ordinary spinning position and operation smoothly proceeds to an ordinary spinning state, thus a ratio success in thread piecing is improved. When the end of the navel is engaged with the thread being spun and moved to the ordinary spinning side, the thread rotatingly moves along the end surface of the inner rotor and when the thread reaches a position corresponding to the thread guide, it is introduced into the thread guide by a guide surface disposed rearward of the thread rotatingly moving direction across the thread guide.

It is preferable that the seed thread is introduced at a speed lower than the ordinary rotational speeds and the navel is moved from the thread piecing position to the ordinary spinning position after the outer rotor and the inner rotor reach the ordinary rotational speeds in the ordinary spinning. Since the navel is moved to the ordinary spinning position in the steady state in which the outer rotor can be easily synchronized with the inner rotor, the thread can be more smoothly introduced into the thread guide.

In the aforesaid thread piecing method, it is preferable that the fiber bundle drawing out and spinning step is carried out by setting the rotational speed of the inner rotor to a speed different from the speed of the fiber bundle drawn out from the fiber collecting portion and the step of introducing the thread into the thread guide is carried out by changing the relative speed between the inner rotor and the fiber bundle after the rotational speeds of the outer rotor and the inner rotor reach the ordinary speeds and introducing the fiber bundle through an guide unit.

The relative speed can be changed by changing the rotational speed of the inner rotor or by changing the speed at which the fiber bundle is drawn out.

In this case, it is preferable that the guide unit is disposed in the vicinity of the inlet of the thread guide of the inner rotor, formed to a such shape as to introduce the thread into the thread guide by permitting the relative movement of the thread guided from the fiber collecting portion to the thread drawing-out path without passing through the thread guide to rearward of the rotational direction of the inner rotor as well as regulating the relative movement of the thread to forward of the rotational direction, spins the thread without causing it to pass through the thread guide in the state that the rotational speed of the inner rotor is faster than the speed of the fiber bundle drawn out from the fiber collecting portion in thread piecing and introduces the thread into the thread guide by reducing the rotational speed of the inner rotor after it reaches the ordinary speed.

When it is assumed that the inside diameter of the outer rotor in the fiber collecting portion is D, the rotational speed of the outer rotor is $R_1$, the rotational speed of the inner rotor is $R_2$ and a spinning speed is V, it is preferable that the outer rotor and the inner rotor are driven to satisfy the relations $\pi DR_2 > \pi DR_1 + V$, when the thread is pieced and $\pi DR_2 < \pi DR_1 + V$, in the ordinary spinning.

Contrary to the mentioned above, it is also possible that the guide unit is disposed in the vicinity of the inlet of the thread guide of the inner rotor, formed to such a shape as to introduce the thread into the thread guide by permitting the relative movement of the thread guided from the fiber collecting portion to the thread drawing-out path without passing through the thread guide to rearward of the rotational direction of the inner rotor as well as regulating the relative movement of the thread to forward of the rotational direction, spins the thread without causing it to pass through the thread guide in the state that the rotational speed of the inner rotor is slower than the speed of the fiber bundle drawn out from the fiber collecting portion in thread piecing and introduces the thread to the thread guide by increasing the rotational speed of the inner rotor after it reaches ordinary speed.

In the above contrary case, it is preferable that the outer rotor and the inner rotor are driven to satisfy the relations $\pi DR_2 < \pi DR_1 + V$, in the accelerated state of the inner rotor and the outer rotor when the thread is pieced, $\pi DR_2 > \pi DR_1 + V$, after the ordinary rotational speed is achieved, and $\pi DR_2 < \pi DR_1 + V$, in the ordinary spinning.

According to a second aspect of the present invention, there is provided a thread piecing apparatus of an open end spinning frame having means for partitioning an outer rotor including a fiber collecting portion to which fibers fed in a separated state are bundled and an opening and a thread drawing-out path, an inner rotor which is disposed in the outer rotor coaxially therewith and includes a thread guide formed thereto for guiding a thread drawn out from the fiber collecting portion to the end of the thread drawing-out path, means for positively driving the outer rotor and the inner rotor independently of each other and a navel disposed movably to the end of the thread drawing-out path wherein when a thread is pieced, the thread is pieced by moving the navel nearer to the opening side of the outer rotor as compared with an ordinary spinning position and thereafter the navel is returned to the ordinary spinning position, the apparatus comprising moving means for moving the navel in axial direction between the ordinary spinning position and the thread piecing position wherein the inner rotor includes a recess formed at a position corresponding to the navel as well as a plurality of guide surfaces formed to a wall member partitioning the thread guide and the guide surfaces among the guide surfaces rearward of the rotatingly moving direction of the pieced thread are located nearer to the outer rotor drive unit side as compared with the forward guide surface.

According to the above thread piecing apparatus, the navel to which the thread drawing-out path is formed is moved by the action of the moving means to the ordinary spinning position where the end surface on the inner rotor side of the navel can be engaged with a thread being drawn out through the thread guide and to the thread piecing position where it cannot be engaged with the thread. After a seed thread is connected to the fiber bundle collected in the fiber collecting portion by the action similar to the first aspect of the invention in the state that the navel is disposed at the thread piecing position, they are drawn out and spun to a thread. Thereafter, the navel is moved to the ordinary spinning position, that is, it is moved to a position where the end surface thereof is held in the recess formed to the inner rotor. Then, the thread rotatingly moves along the end surface of the inner rotor while the navel is being moved and is introduced into the thread guide when it reaches a position corresponding to the thread guide.

It is preferable that the recess has a taper surface formed to the peripheral edge thereof. When the end surface of the navel advances into the recess of the inner rotor while the navel is being moved from the thread piecing position to the ordinary spinning position, the thread rotatingly moves along the taper surface of the inner rotor, thus the thread is smoothly introduced into the thread guide as well as the thread is prevented from being broken when it is introduced into the thread guide.

It is preferable to form a guide recess to the end surface on the opening side of the inner rotor at a position nearer to rearward of the rotational direction of the inner rotor as compared with the thread guide so that the guide recess communicate to the thread guide. In the above arrangement, when the end surface of the navel advances into the recess of the inner rotor while the navel is being moved from the thread piecing position to the ordinary spinning position, the thread rotatingly moves along the end surface or the taper surface of the inner rotor, thus the thread is smoothly introduced into the thread guide through the guide recess.

The moving means can be arranged such that it is operated by a thread piecing apparatus moving along the machine frame of an open end spinning frame including a plurality of spinning units. A thread piecing job at each spinning unit is automatically carried out by the thread piecing apparatus. The above moving means is operated by the thread piecing apparatus and the navel is moved to the thread piecing position and to the ordinary spinning position when the thread is pieced.

It is preferable that the moving means includes a support member for supporting the navel, a lever extending in a direction perpendicular to the support member and engaged with the support member on the first end side thereof, urging means for urging the lever to a direction for holding the navel to the ordinary spinning position and the thread piecing apparatus includes operation means for pressing the lever against the urging means. In the thread piecing apparatus, since a drive unit for moving the navel to an evacuating position need not be provided with each spinning unit, the structure of the apparatus can be simplified.

The lever is urged by the urging means in a direction for holding the navel at the ordinary spinning position. The operation means is actuated when a thread is pieced to thereby press the lever against the urging force of the urging means, so that the navel is disposed at the thread piecing position. When the pressure applied by the operation means is released, the lever is rotated by the urging force of the urging means, so that the navel is automatically disposed at the ordinary spinning position.

Further, according to the present invention, the thread piecing apparatus further comprises a guide unit disposed in the vicinity of the inlet of the thread guide of the inner rotor and introducing the thread into the thread guide by permitting the relative movement of the thread guided from the fiber bundling or collecting portion to the thread drawing-out path without passing through the thread guide to one of the rotational directions of the inner rotor as well as regulating the relative movement thereof to the other of the rotational directions, means for detecting the rotation signal of the outer rotor, arithmetic operation means for calculating the rotational speed the outer rotor based on the signal detected by the rotational speed sensing means and control means for controlling the drive means so that the outer rotor and the inner rotor achieve predetermined rotational speeds.

It is preferable that the guide unit is formed such that the base end thereof is secured to the bottom of the groove forming the thread guide and the extreme end thereof extends to a position projecting from the end surface of the inner rotor on the opening side of the outer rotor, and a guide surface is disposed to the portion projecting from the end surface on the opening side forward or rearward of the rotational direction of the inner rotor in order to guide a thread, which relatively moves toward the guide unit on the end surface on the opening side, to the extreme end side of the guide unit.

Fibers fed in a separated state in the ordinary spinning are bundled to the fiber bundling portion of the outer rotor. The fiber bundle bundled in the fiber bundling portion is taken off therefrom and drawn out as a thread from the thread drawing-out path through the thread path of the inner rotor while being twisted. In the thread piecing, a seed thread is introduced into the outer rotor from the thread drawing-out path in the state that at least the outer rotor is rotated and after the extreme end of the seed thread reaches a position where it comes into contact with the fiber bundle in the fiber bundling portion, the fiber bundle in the fiber bundling portion is drawn out together with the seed fiber and a thread is spun without passing through the thread guide of the inner rotor. Then, after the rotational speeds of the outer rotor and the inner rotor reach the ordinary rotational speeds, the relative speed between the inner rotor and the fiber bundle is changed and the thread drawn out from the fiber bundling portion is introduced into the above fiber guide through the guide unit. Thereafter, spinning is continuously carried out at the rotational speed in the ordinary spinning.

DESCRIPTION OF PREFERRED EMBODIMENTS

Figure 1:
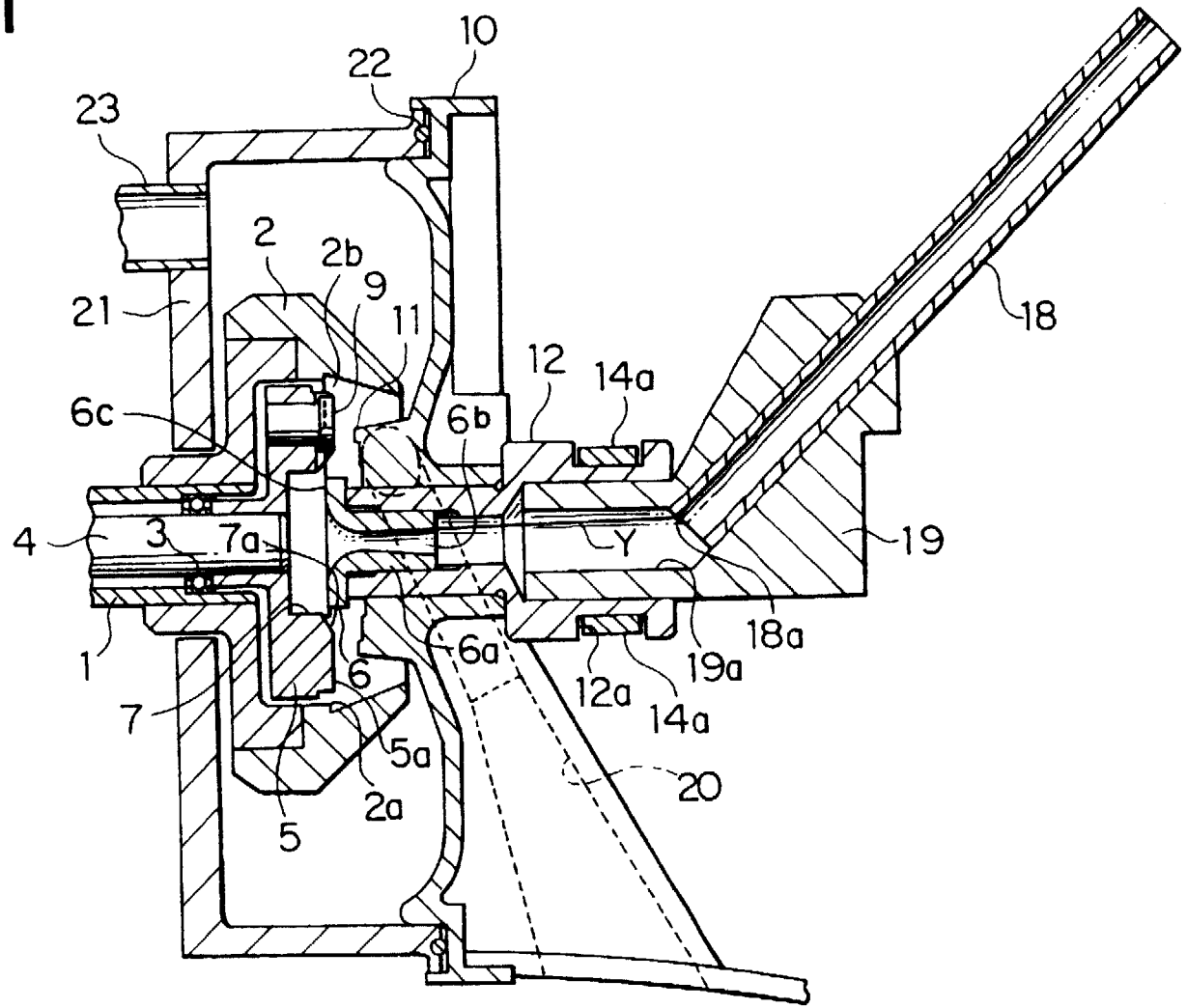
FIG. 1 is a partial cross sectional view of an embodiment of an open end spinning frame according to the present invention.

An embodiment of the present invention will be described below with reference to FIG. 1-FIG. 7. As shown in FIG. 1, an outer rotor 2 is secured to the extreme end of a hollow rotor shaft 1 as a rotary shaft so as to rotate integrally therewith, the rotor shaft 1 being rotatably supported on a machine frame in a known arrangement (for example, Japanese Unexamined Patent Publication No. 5-33226, Japanese Unexamined Patent Publication No. 6-123020 and the like) as well as driven in rotation by a drive means (any of them not shown). Bearings 3 are secured to the inside of both the ends (only one end is shown) of the rotor shaft 1 and a shaft 4 passing through the rotor shaft 1 is rotatably supported through the bearings coaxially with the rotor shaft 1. The shaft 4 has an inner rotor 5 secured at an end thereof so as to rotate therewith and the base end of the shaft 4 is abutted against a thrust bearing (not shown). The shaft 4 is driven in the same direction as the outer rotor 2 independently of the rotor shaft 1 or with a particular relationship therewith.

Figure 2:
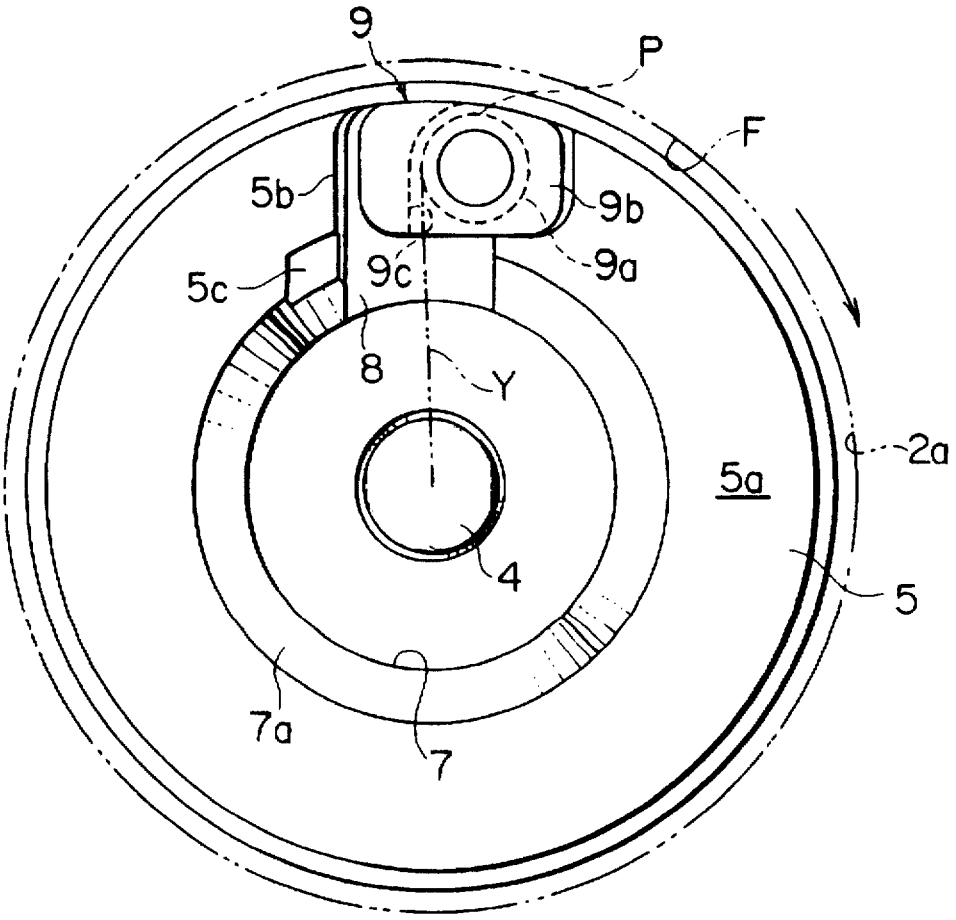
FIG. 2 is a front elevational view of an inner rotor.

As shown in FIG. 2, the inner rotor 5 is formed in a disk shape with a recess 7 formed at the center thereof which has a diameter larger than the maximum outside diameter of a navel 6 (refer to FIG. 1) and a taper surface 7*a* is formed or the peripheral edge of the opening end of the recess 7. The inner rotor 5 is disposed in such a state that the end surface 5*a* of the inner rotor 5, on the opening side of the outer rotor 2 is positioned nearer to the opening side of the outer rotor 2 than that plane including a fiber collecting and bundling V-shaped portion (hereinafter, referred to as a fiber bundling portion) 2*a* formed at the maximum inside diameter portion of the outer rotor 2. A groove or channel constituting a thread guide 8 from a position corresponding to the fiber bundling portion 2*a* to the recess 7 is formed in the inner rotor 5 with the same side thereof opened as the opening of the outer rotor 2. As a guide unit through which the fiber bundle is introduced to the thread guide 8, a guide member 9 is disposed forwardly in the rotational direction (clockwise direction of FIG. 2) of the inner rotor 5 at the inlet of the thread guide 8. The guide member 9 is disposed so that an end surface thereof projects beyond the end surface 5*a* of the inner rotor 5. Further, an inclined surface 5*b* as a guide surface along the thread guide 8 is formed in the end surface 5*a* of the inner rotor 5 rearward of the rotational direction of the inner rotor 5 across the thread guide 8, that is, rearward of the thread insertion moving direction. Also, a guide recess 5*c* as a guide surface communicating with the thread guide 8 is formed at a position corresponding to the side end portion of the taper surface 7*a* of the inclined surface 5*b*. The outside diameter of the inner rotor 5 is formed larger than the inside diameter of the opening of the outer rotor 2. Further, the outer rotor 2 is composed of two parts engaged with and secured to each other.

Figure 3:
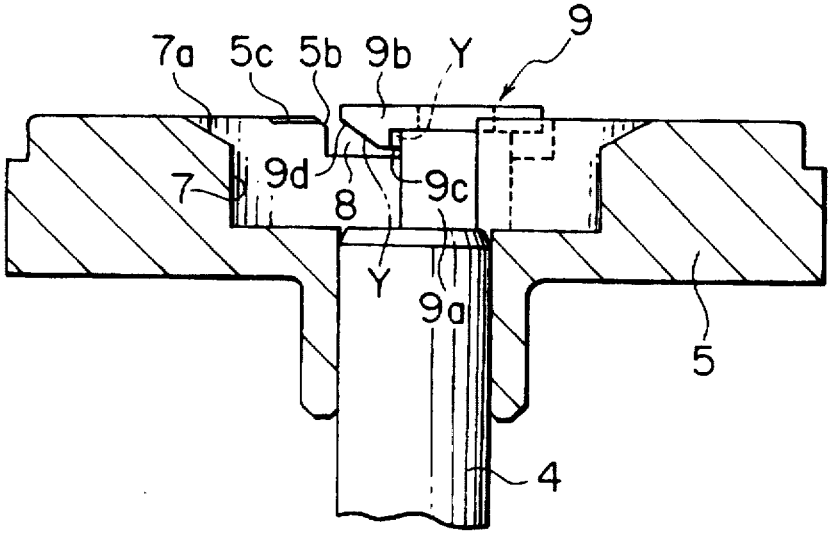
FIG. 3 is a cross sectional view of an inner rotor.

As shown in FIG. 3, the guide member 9 is composed of a pin 9*a* having a diameter larger than the diameter of a thread y, and a guide piece 9*b* inserted into the extreme end of the pin 9*a*. The guide piece 9*b* has a guide surface 9*c* formed thereto which is composed of a quarter arc surface along the& outer periphery of the pin 9*a* on a side confronting the bottom of the thread guide 8 and a plane continuous to the arc surface and extending in the tangential direction thereof. The plane of the guide surface 9*c* is formed to extend in parallel with the longitudinal direction of the thread guide 8. Further, the guide piece 9*b* has an inclined surface 9*d* formed thereto the distance of which from the bottom of the thread guide 8 increasing rearwardly of the rotational direction of the inner rotor 5. The inclined surface 9*d* constitutes a guide surface located at a position forward of the thread insertion moving direction across the thread guide 8. The inclined surface 5*b* and the guide recess 5*c* located rearward of the thread insertion moving direction across the thread guide 8 are located nearer to an outer rotor drive unit as compared with the inclined surface 9*d* as the guide surface located forward of the thread rotatingly moving direction.

Figure 4:
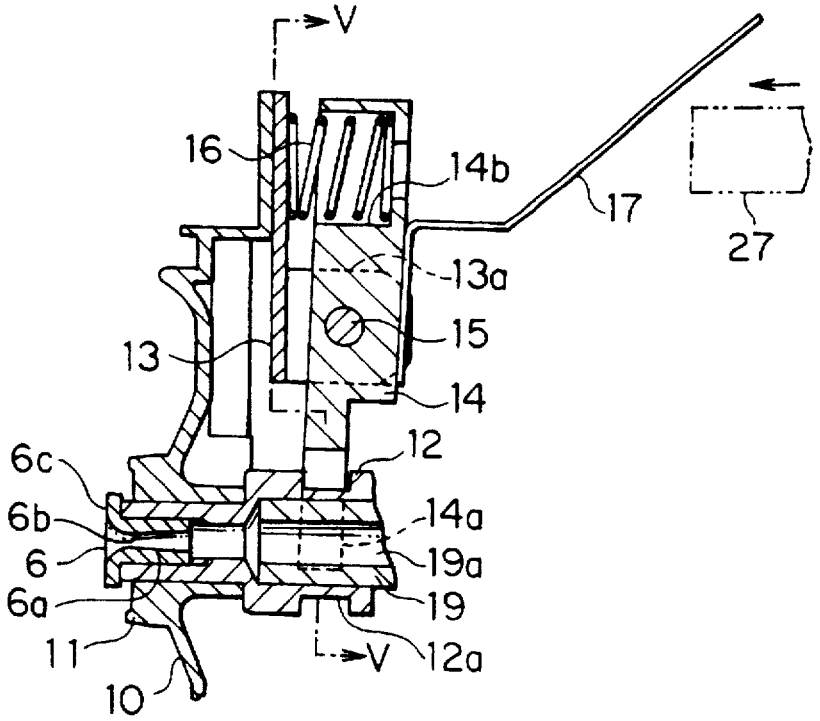
FIG. 4 is a side elevational view of a navel moving means.
Figure 5:
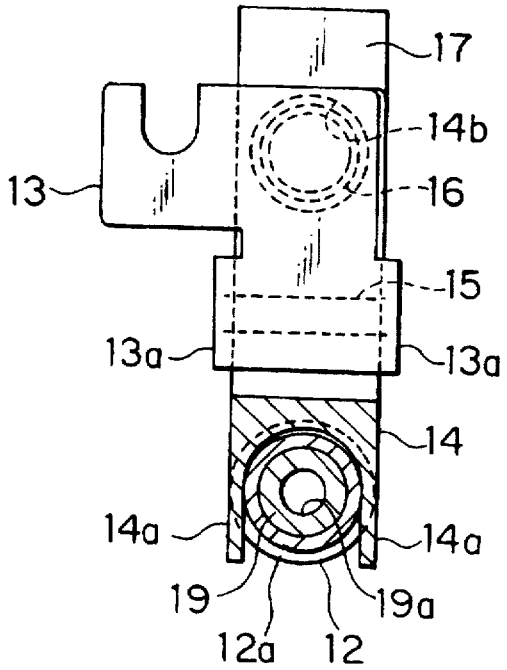
FIG. 5 is a cross sectional view taken along the line V—V of FIG. 4.

A boss 11 is formed at the center of a housing 10 disposed at a position confronting the open side of the outer rotor 2 in the state that it projects into the outer rotor 2. A cylindrical support member 12 supporting the navel 6 is disposed at the center of the boss 11 coaxially with the inner rotor 5 so that it can reciprocate in an axial direction. The cylindrical portion 6*a* of the navel 6 is engaged with and secured to the extreme end side of the support member 12. As shown in FIG. 4, a lever 14 is swingably supported between a pair of the support pieces 13*a* of a support bracket 13 secured to the housing 10 through a support shaft 15. As shown in FIG. 5, the lever 14 has a pair of engaging portions 14*a* extending along the longitudinal direction thereof and formed at the first end thereof, and an accommodating unit 14*b* formed at the second end thereof, respectively. The lever 14 is disposed approximately perpendicularly to the support member 12 in the state that the engaging portion 14*a* thereof is engaged with an engaging groove 12*a* formed to the base end side of the support member 12, and the lever 14 is urged in a direction for holding the navel 6 at an ordinary spinning position by a coil spring 16 as an urging means accommodated in the accommodating unit 14*b* with an end thereof abutted against the support bracket 13. A leaf spring 17 extending to the second end side of the lever 14 is secured to the lever 14 integrally therewith. The support member 12, the lever 14, the coil spring 16 and the leaf spring 17 constitute a movement means for moving and disposing the navel 6 at the ordinary spinning position where the end surface 6c of the navel 6 can be engaged with a fiber bundle F drawn out through the thread guide 8 and at a thread piecing position (retracted position) where the end surface 6c of the navel 6 cannot be engaged with the fiber bundle F.

A block 19 to which the base end of a yarn pipe 18 is secured is engaged with and secured to the base end of the support member 12. A path 19a is formed in the block 19 and the yarn pipe 18 extends while being bent so as to be secured to the path 19a. The yarn pipe 18 and the path 19a constitute of the thread drawing-out path. An end of a fiber transportation path 20 for guiding fibers separated from each other by a combing roller (not shown) into the outer rotor 2 is opened to the peripheral surface of the boss 11. Further, a casing 21 covering the outer rotor 2 is disposed at a position confronting the housing 10 in the state that it is abutted against the end surface of the housing 10 through an O-ring 22. The casing 21 is connected to a negative pressure source (not shown) through a pipe 23.

Figure 7:
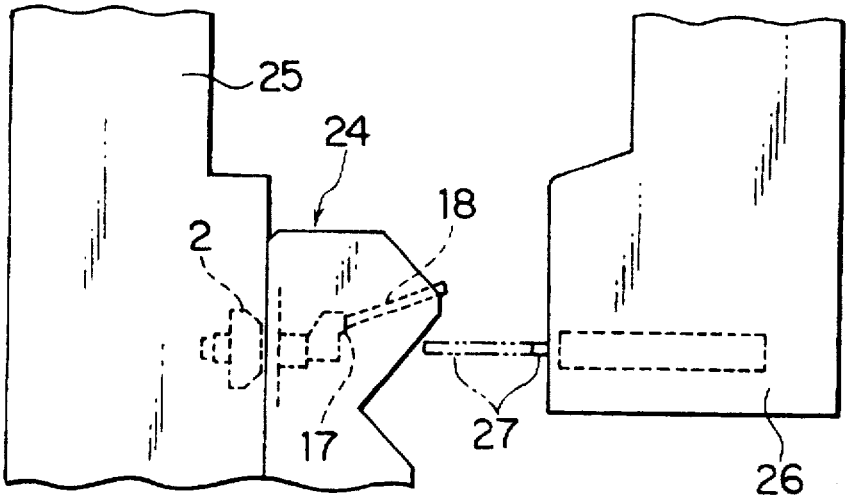
FIG. 7 is a schematic side elevational view showing the relationship between a spinning unit and a thread piecing apparatus.

As shown in FIG. 7, a thread piecing apparatus 26 is provided with a frame base 25 including a multiplicity of spinning units 24 each having the device arranged as described above and moves along the longitudinal direction of the frame base 25 (in the direction perpendicular to the paper surface of FIG. 7). The thread piecing apparatus 26 stops at a position confronting the spinning unit 24 which requires thread piecing and carries out a thread piecing job. The thread piecing apparatus 26 includes an arm 27 as a operation means for pressing the above leaf spring 17 when the thread piecing operation is carried out. The arm 27 advances into a hole (not shown) formed in the cover of the spinning unit 24 so as to press the leaf spring 17.

Next, operation of the apparatus arranged as described above will be described. The outer rotor 2 and the inner rotor 5 are driven in rotation in the same direction by the action of the drive means through the rotor shaft 1 and the shaft 4, respectively. The inner rotor 5 is rotated at a rotational speed similar to a speed at which the fiber bundle F is taken off from the fiber bundling portion 2a which is different from the rotational speed of the outer rotor 2 (a little faster than the rotational speed of the outer rotor 2). The fibers separated from each other by the action of the combing roller and fed into the outer rotor 2 from the fiber transportation path 20 in this state adhere to the inner wall surface 2b of the outer rotor 2 as well as slide along the inner wall surface 2b and are bundled to the fiber bundling portion 2a as the maximum inside diameter portion. The fiber bundle F bundled to the fiber bundling portion 2a are connected to a thread Y drawn out by a drawing-out roller (not shown) through the yarn pipe 18 and taken off from the fiber bundling portion 2a as the thread Y is drawn out, thus the fiber bundle F is drawn out as the thread Y while being twisted by the rotation of the outer rotor 2. Twist applied to the thread Y and the fiber bundle F is transmitted up to the fiber bundling portion 2a of the outer rotor 2 from the base end 18a of the yarn pipe 18 as a starting point.

In the ordinary spinning operation, the lever 14 is held at a position for disposing the navel 6 at the ordinary spinning position by the urging force of the coil spring 16, and the end surface 6c of the navel 6 projects advances into the recess 7 of the inner rotor 5, thus the end surface of the navel 6 is located on the plane including the fiber bundling portion 2a. In this state, the fiber bundle F taken off from the fiber bundling portion 2a is introduced to the thread drawing-out path 6b through the thread guide 8 in the state that it is in contact with the pin 9a of the guide member 9. Therefore, the angle between the direction in which the fiber bundle F is drawn out in the vicinity of a taking-off point (point where twist is applied) P and the fiber bundle F bundled to the fiber bundling portion 2a, that is, a twist application angle is made to an obtuse angle. Then, the difference of path of the fiber bundle F subjected to the twist while being taken off from the fiber bundling portion 2a between the inside and the outside thereof is reduced, thus the fiber bundle F is twisted by an approximately uniform force in the state that fibers are stretched straight. As a result, irregular portions are difficult to appear in the drawn-out thread and the feeling of sheet made by the thread will be improved.

Figure 6:
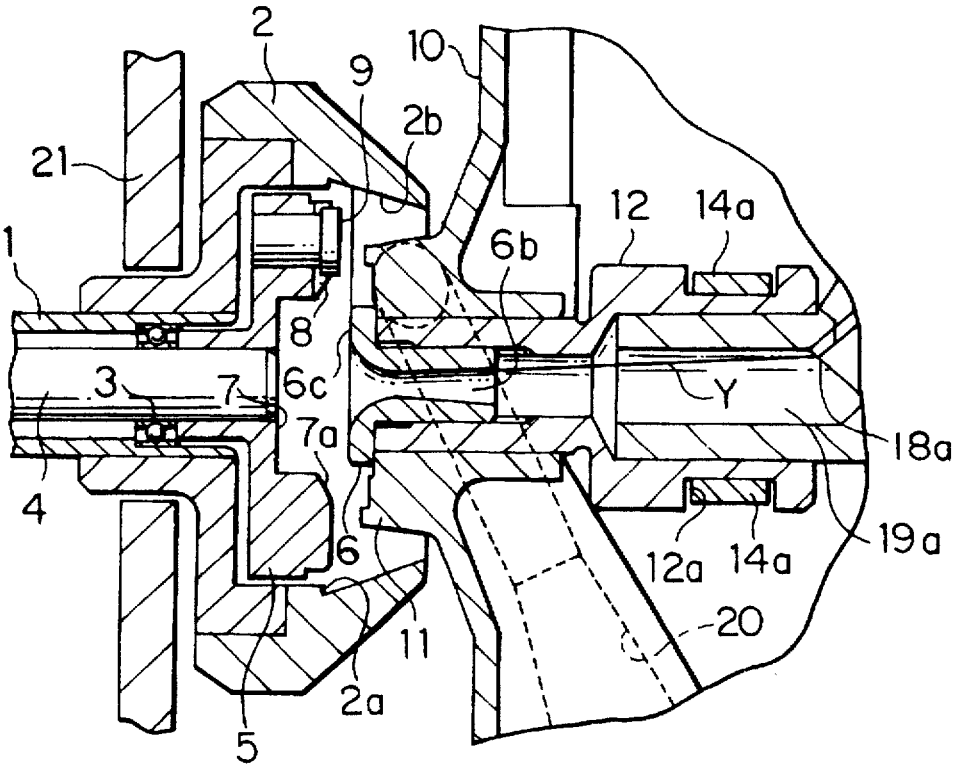
FIG. 6 is a partial cross sectional view showing the state that the navel is disposed at an evacuating position.

When one of the spinning units 24 requires thread piecing, the thread piecing apparatus 26 stops at a position corresponding to the spinning unit 24. Next, the arm 27 extends and is located at a thread piecing position where the leaf spring 17 is pressed by the arm 27, so that the leaf spring 17 is pressed to thereby rotate the lever 14 counterclockwise in FIG. 4. The rotation of the lever 14 permits the navel 6 to move in the axial direction of the inner rotor 5 together with the support member 12, thus the navel 6 is disposed at a thread piecing position where the end surface 6c thereof is withdrawn from the recess 7 of the inner rotor 5 as shown in FIG. 6. Since the lever 14 receives the force of the arm 27 through the leaf spring 17, an unreasonable force does not act on the lever 14 and the support member 12 even if the position of the arm 27 is a little dislocated.

Next, a seed thread is introduced into the outer rotor 2 through the yarn pipe 18 and the thread drawing-out path 6b while the outer rotor 2 and the inner rotor 5 are rotated. The seed thread is introduced in the state that the rotational speeds of both the rotors 2, 5 are slower than the rotational speeds thereof in the ordinary spinning state. Since the end surface 6c of the navel 6 is held at the position where the navel 6c withdrawn from the recess 7 of the inner rotor 5, the seed thread easily reaches the fiber bundling portion 2a along the inner wall surface 2b. After the extreme end of the seed thread reaches a position where it comes into contact with the fiber bundle in the fiber bundling portion 2a, the seed thread is drawn out by the forward rotation of the not shown drawing-out roller so that the fiber bundle F bundled at the fiber bundling portion 2a is coiled around the end of the seed thread and drawn out together with the seed thread by being taken off from the fiber bundling portion 2a. Then, the thread Y is spun without passing through the thread guide 8 of the inner rotor 5 as shown in FIG. 6.

Thereafter, when the rotational speeds of the outer rotor 2 and the inner rotor 5 reach the ordinary rotational speeds in ordinary spinning, the pressure applied by the arm 27 is released and the lever 14 is turned clockwise in FIG. 4 by the urging force of the coil spring 16 so that the end surface 6c of the navel 6 advances into the recess 7 of the inner rotor 5 and the navel 6 returns the ordinary spinning position where its end is disposed on the plane including the fiber bundling portion 2a.

The end surface 6c of the navel 6 is engaged with the thread Y being spun while the navel 6 is moved. When the navel 6 moves to the ordinary spinning position, the thread Y is pressed against the end surface 5a of the inner rotor 5 by being pressed the end surface 6c. Then, when the rotational speed of the inner rotor 5 is made a little slower than the speed at which the fiber bundle F is taken off, the point P where the fiber bundle F is taken off is relatively moved forward of the rotational direction of the inner rotor 5. A portion of the thread Y rotatingly moves along the end surface 5a and the taper surface 7a of the recess 7 and when it reaches a position confronting the guide recess 5c and the inclined surface 5b, the thread Y is introduced to the thread guide 8 along the guide recess 5c and the inclined surface 5b as well as introduced to the ordinary spinning position by being guided by the inclined surface 9d of the guide piece 9b. Then, spinning is transferred to the ordinary spinning in the state that the navel is held at the ordinary spinning position, so that the thread Y connected to the fiber bundle of the fiber bundling portion 2a moves into the thread guide 8 while in contact with the pin 9a and is drawn out from the thread taking-out path 6b as shown in FIG. 3.

Since the inclined surface 5b is formed to extend along the thread guide 8 and the thread Y rotatingly moves in the state that it extends radially from the thread drawing-out path 6b as shown in FIG. 2, the thread Y is difficult to be introduced into the thread guide 8 only by the inclined surface 5b. However, since the guide recess 5c is formed in this embodiment, the thread Y is introduced into the guide recess 5c first as well as smoothly introduced into the thread guide 8 through the guide recess 5c and then smoothly introduced to the ordinary spinning position by being guided by the inclined surface 9d of the guide piece 9b.

Since the taper surface 7a is formed to the peripheral edge of the recess 7 in this embodiment, the thread Y can be smoothly introduced into the thread guide 8. Further, since the peripheral edge of the recess 7 is not formed to an acute angle, the thread can be prevented from being cut off when it is introduced into the thread guide 8. Note, the same advantage can be achieved even if an arc surface is formed in place of the taper surface 7a.

Since the end surface of the guide piece 9b projects beyond the end surface 5a of the inner rotor 5 in this embodiment, when the thread rotatingly moving on the end surface 5a reaches the position corresponding to the guide piece 9b, the thread Y can easily move to the inclined surface 9d side of the guide piece 9b, thus it can be easily introduced into the thread guide 8.

In this embodiment, after the rotational speeds of the outer rotor 2 and the inner rotor 5 reach the ordinary rotational speeds in the ordinary spinning, the navel 6 is moved from the thread piecing position to the ordinary spinning position. Since the rotational speed of the outer rotor 2 is unstably synchronized with that of the inner rotor 5 before they reach the ordinary rotational speeds, the spinning state of the thread Y is also unstable. However, after the ordinary rotational speeds are reached, the spinning state of the thread Y is stabilized. Therefore, the thread Y is rotatingly moved up to the position corresponding to the thread guide 8 by being pressed against the end surface 5a of the inner rotor 5 and the taper surface 7a and securely introduced into the thread guide 8.

Since the moving means for moving the navel 6 to the thread piecing position and the ordinary spinning position is operated by the arm 27 provided with the thread piecing apparatus 26 in this embodiment, a thread piecing job can be carried out without the assistance of the operator.

Further, the lever 14 constituting the moving means urges the navel 6 to the ordinary spinning position through the coil spring 16 as the urging means in this embodiment. Consequently, when the operating force for pressing the lever 14 against the urging force of the coil spring 16 is released from holding the navel 6 at the thread piecing position, the navel 6 automatically returns to the ordinary spinning position. In addition, since the operating force for pressing the lever 14 is applied by arm 27 provided with the thread piecing apparatus 26, a drive unit for pressing the lever 14 need not be provided with each spinning unit 24.

In the thread piecing method of the open end spinning frame shown in FIG. 1–FIG. 7, it is preferable that the rotational speeds of the inner rotor and the outer rotor are easily controlled in the thread piecing and that further operation can be easily transferred from the spinning state when a thread is pieced to the ordinary spinning state.

Figure 9:
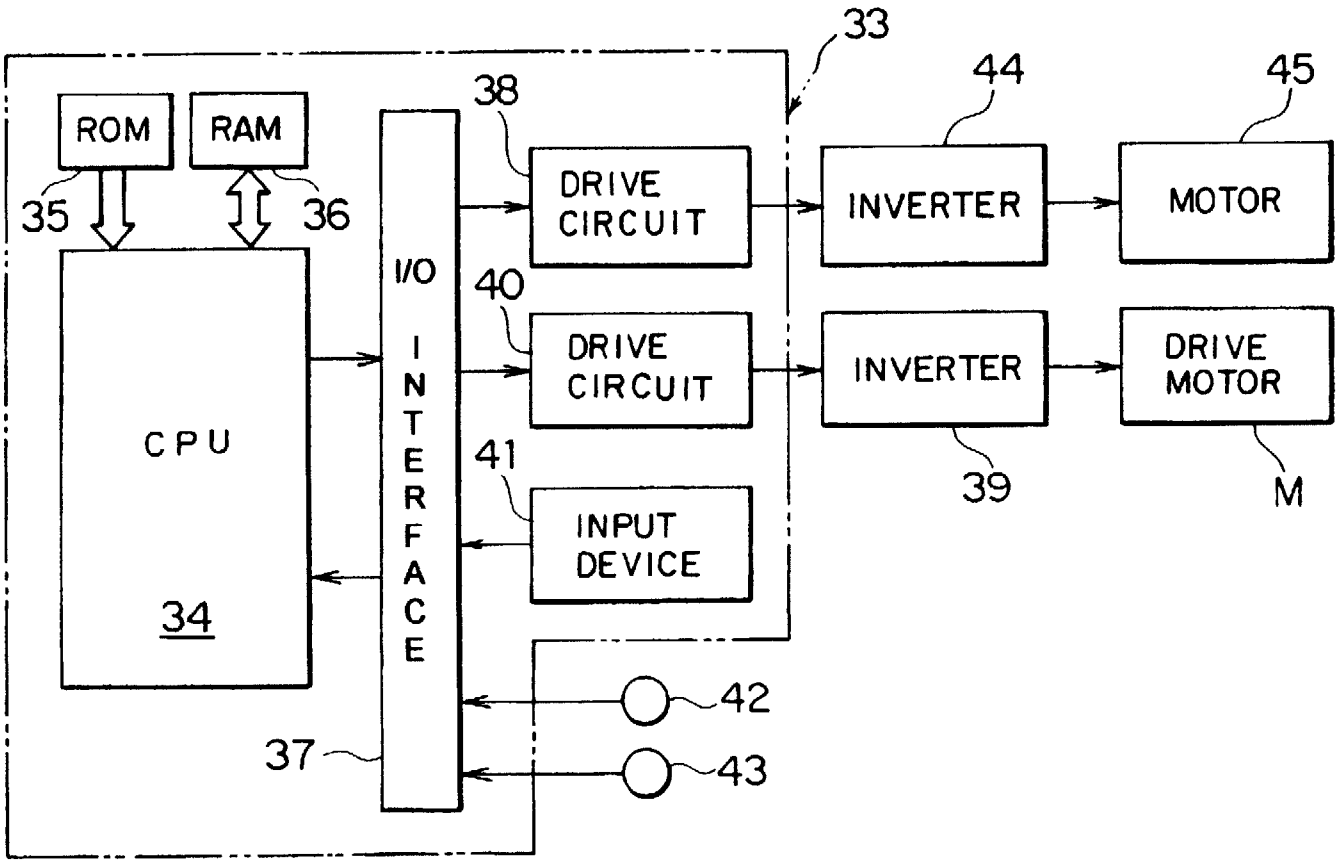
FIG. 9 is a block diagram of a controller.

FIG. 9 shows a controller 33 for controlling the drive of the outer rotor 2 and the inner rotor 5 in the aforesaid preferable state. The controller 33 includes a central processing unit (hereinafter, referred to as a CPU) 34 as an arithmetic operation means and a control means, a program memory 35 and a working memory 36. The CPU 34 is connected to first and second sensors 42, 43 through an I/O interface 37 as well as to an inverter 44 through the I/O interface 37 and a drive circuit 38. Further, the CPU 34 is connected through a drive circuit 40 to an inverter 39 having a motor M connected thereto. The program memory 35 is composed of a read only memory (ROM) and stores a thread piecing operation program and the like. The working memory 36 is composed of a random access memory (RAM) and temporarily stores data input from an input unit 41, data arithmetically processed by the CPU 34, and the like. The CPU 34 controls the drive motor M and a motor 45 so that the rotational speeds of both the rotors 2,5 are set to predetermined rotational speeds corresponding to the spinning conditions input from the input unit 41. The CPU 34 calculates the rotational speed of the outer rotor 2 based on a signal output from the first sensor 42 and calculates the rotational speed of the inner rotor 5 corresponding to the above rotational speed. Then, the CPU 34 controls the motor 45 so that the above rotational speed is achieved. That is, the CPU 34 controls the rotational speed of the inner rotor 5 based on the rotational speed of the outer rotor 2.

Next, operation of the apparatus arranged as described above will be described with reference to FIG. 1 and FIG. 9. The outer rotor 2 of each spindle is driven through a drive belt (not shown) which is in contact with the rotor shaft 1 through a driving relationship, the motor 45 is driven at a predetermined speed based on the rotational speed of the outer rotor 2, and the inner rotor 5 is driven at a predetermined speed in the same direction as that of the outer rotor 2. When it is assumed that the diameter of the fiber bundling portion 2a is D, the number of rotation of the outer rotor 2 is $R_1$, the number of rotation of the inner rotor 5 is $R_2$ and a spinning speed is V, the inner rotor 5 is driven at a speed which satisfies $\pi DR_2<\pi DR_1+V$ and is a little slower than a speed at which the fiber bundle F is taken off from the fiber bundling portion 2a (a speed a little faster than the rotational speed of the outer rotor 2).

Fibers separated from each other by the action of the combing roller and fed from the fiber transportation path 20 into the outer rotor 2 in this state adhere to the inner wall surface of the outer rotor 2 as well as slide along the inner wall surface and are bundled to the fiber bundling portion 2a as the maximum inside diameter portion. The fiber bundle bundled at the fiber bundling portion 2a is connected to the thread Y drawn out by the drawing-out roller (not shown) through the yarn pipe 18 and taken off from the fiber bundling portion 2a as the thread Y is drawn out and then drawn out while being twisted as the thread Y. The twist applied to the thread Y and the fiber bundle is transmitted up to the fiber bundling portion 2a from the end of the yarn pipe 18 as a starting point.

The CPU 34 calculates the rotational speed of the outer rotor 2 based on the signal output from the first sensor 42 and calculates the rotational speed of the inner rotor 5 corresponding to the above rotational speed. Then, the CPU 34 outputs a command signal for rotating the inner rotor 5 at the rotational speed to the inverter 44. The inverter 44 drives the motor 45 based on the command signal from the CPU 34. Then, the inner rotor 5 is driven at the predetermined rotational speed corresponding to the rotational speed of the outer rotor 2. The rotational speed of the shaft 4 is detected by the second sensor 43 and fed back to the CPU 34.

Figure 8:
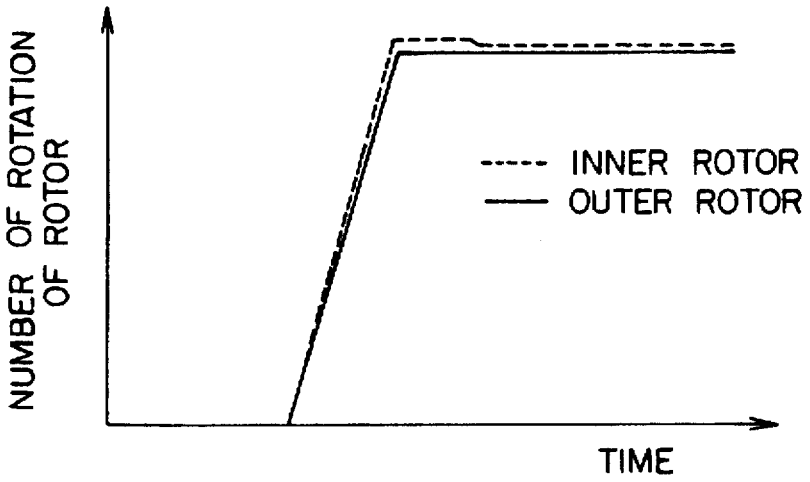
FIG. 8 is a graph showing the change of the numbers of rotation of both the rotors when a thread is pieced.
Figure 10:
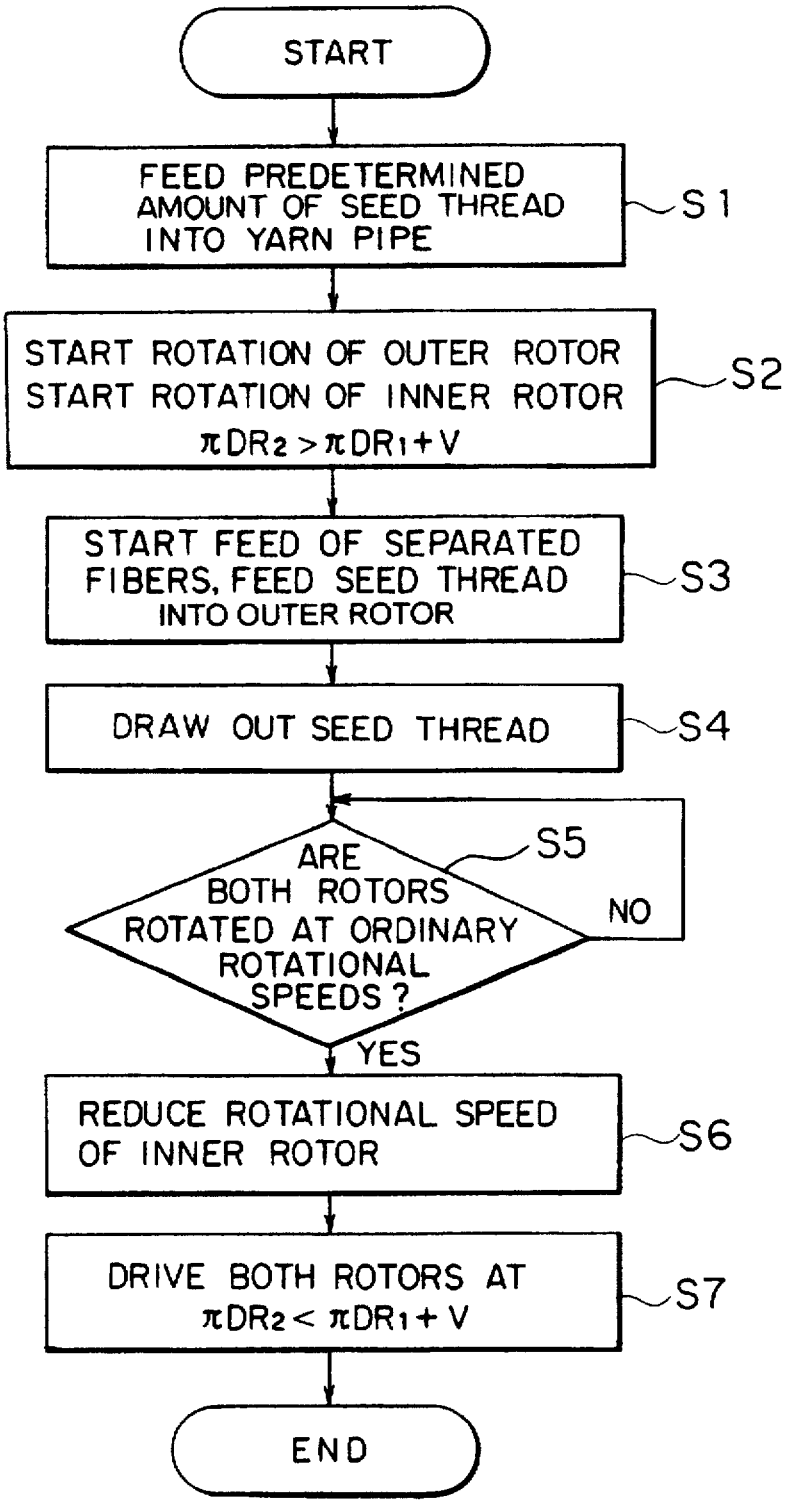
FIG. 10 is a flowchart showing actions carried out to piece a thread.

Next, thread piecing operation will be described with reference to the flowchart of FIG. 10. Thread piecing starts in the state that the outer rotor 2 is stopped by a brake and the rotation of the inner rotor 5 is also stopped. First, the not shown drawing-out roller is reversed to thereby feed the seed thread into the yarn pipe 18 a predetermined length at step S1. Next, the brake of the outer rotor 2 is released to allow rotation of the outer rotor 2, and the motor 45 is driven to thereby rotate the inner rotor 5, at step S2. The CPU 34 controls the motor 45 based on the signal output from the first sensor 42 so that the inner rotor 5 is rotated at a rotational speed satisfying $\pi DR_2 > \pi DR_1 + V$. Then, the inner rotor 5 is driven so that the number of rotation (RPM) thereof is larger than that of the outer rotor 2 at all times as shown in FIG. 8.

After the rotational speeds of both the rotors 2, 5 reach first predetermined rotational speeds which are slower than those in the ordinary spinning, separated fibers start to be fed as well as a seed thread is introduced into the outer rotor 2 at step S3. After the extreme end of the seed thread reaches a position where it comes into contact with a fiber bundle in the fiber bundling portion 2*a*, the seed thread is drawn out by the forward rotation of the drawing-out roller at step S4, the fiber bundle F bundled to the fiber bundling portion 2*a* is coiled around the end of the seed thread, taken off from the fiber bundling portion 2*a* and drawn out together with the seed thread. Then, a thread Y is spun without passing through the thread guide 8 of the inner rotor 5 (FIG. 2).

Since the rotational speed of the inner rotor 5 is faster than the taking-off speed of the thread Y in this state, the thread Y extending from the fiber bundling portion 2*a* to the thread drawing-out path 19*a* relatively moves rearward of the rotational direction of the inner rotor 5 with respect to it.

The CPU 34 determines whether or not the outer rotor 2 and the inner rotor 5 reach the ordinary rotational speeds in the ordinary spinning at step S5, and when they reach them, the process goes to step S6 where the CPU 34 controls the motor 45 so that the rotational speed of the inner rotor 5 is made slower than the taking-off speed of the thread Y. As a result, the thread Y extending from the fiber bundling portion 2*a* to the thread drawing-out path 19*a* relatively moves forward of the rotational direction of the inner rotor 5. Then, the thread Y is guided by the thread guide 8 and introduced to the ordinary spinning position by being guided by the inclined surface 9*d* of the guide member 9.

Thereafter, operation is transferred to the ordinary spinning and the thread Y connected to the fiber bundle F of the fiber bundling portion 2*a* moves in the thread guide 8 while in contact with the pin 9*a* and is drawn out from the thread drawing-out path 19*a*. In the ordinary spinning, both the rotors 2, 5 satisfy $\pi DR_2 < \pi DR_1 + V$, so that the inner rotor 5 is rotated at a rotational speed equal to the taking-off speed of the fiber bundle.

As described above, when the thread is pieced, it suffices only to drive the inner rotor 5 at a speed to permit the thread Y extending from the fiber bundling portion 2*a* to the thread drawing-out path 19*a* to relatively move with respect to the rotational direction of the inner rotor 5, that is, at a speed different from the speed at which the thread Y is drawn out. Therefore, even if the rotational speed of the inner rotor 5 is varied a little, since it satisfies the condition that it is different from the drawing-out speed of the thread Y, the motor 45 can be easily controlled. Further, since the thread Y is introduced into the thread guide 8 by changing the relationship between the rotational speed of the inner rotor 5 and the rotational speed of the outer rotor 2 after both the rotors 2, 5 reach the ordinary rotational speeds, that is, in the state that the thread Y is stably spun, the thread Y is smoothly introduced into the thread guide 8.

This embodiment has the following advantages in addition to the above ones.

(a) In the thread piecing, the thread Y is spun without passing through the thread guide 8 in the state that the rotational speed of the inner rotor 5 is faster than the speed of the fiber bundle F (thread Y) drawn out from the fiber bundling portion 2*a* and after the rotational speed of the inner rotor 5 reaches the ordinary speed, the rotational speed thereof is lowered and the thread is introduced into the thread guide 8. Thus, the relationship $\pi DR_2 > \pi DR_1 + V$ employed when the thread is pieced can be easily transferred to the relationship $\pi DR_2 < \pi DR_1 + V$ in the ordinary spinning only by reducing the rotational speed of the inner rotor 5 to the predetermined speed in the speed change effected after the ordinary speed is reached.

(b) Even if the rotational speed of the outer rotor 2 is made unstable by the slip caused between the aforesaid drive belt (not shown) and the rotor shaft 1, since the rotational speed of the inner rotor 5 is controlled based on the rotational speed of the outer rotor 2, both the rotors 2, 5 can be easily synchronized with each other. Further, since the shaft 4 of the inner rotor 5 also serves as the drive shaft of the motor 45, the synchronization of both the rotors 2, 5 can be more easily controlled.

Note, the present invention is not limited to the above embodiment but may be embodied, for example, as described below.

Figure 11:
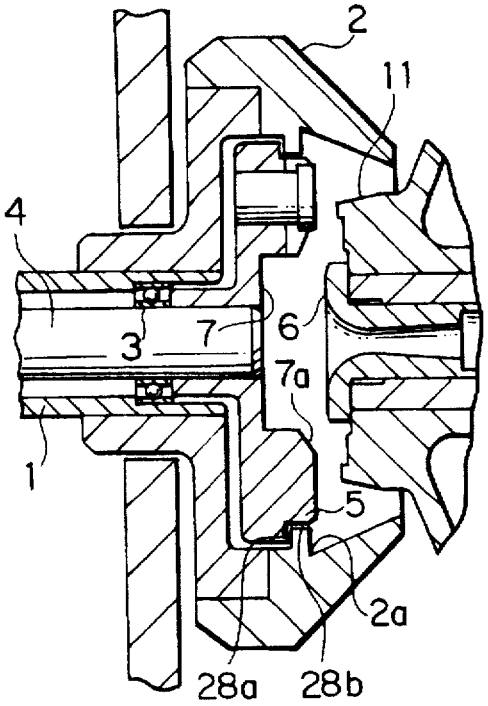
FIG. 11 is a partial cross sectional view of a modification.

(1) As shown in FIG. 11, a step portion 28*a* is formed to the inner surface of an outer rotor 2 at a portion lower than a fiber bundling portion 2*a* so that the step portion 28*a* has a smaller diameter on the bottom side thereof as well as a step portion 28*b* is formed to a position of the outer periphery of an inner rotor 5 which corresponds to the step portion 28*a*. In this case, since the step portions 28*a*, 28*b* act as a labyrinth, short fibers and the like are prevented from entering the bottom side of the outer rotor 2 from a gap between the outer rotor 2 and the inner rotor 5, thus a bearing 3 supporting a shaft 4 is prevented from being clogged with fiber dusts. Further, a labyrinth may be disposed between the bottom of the outer rotor 2 and the bottom of the inner rotor 5 in place of the step portions 28*a*, 28*b*.

Figure 12A:
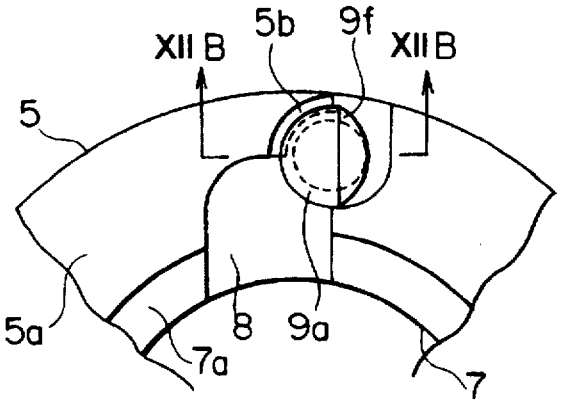
FIG. 12A is a partial front elevational view of a modification of the inner rotor.
Figure 12B:
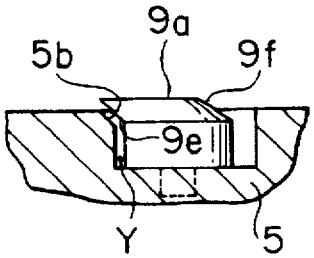
FIG. 12B is a cross sectional view taken along the line XIIB—XIIB of FIG. 12A.

(2) As shown in FIGS. 12A and 12B, a guide member 9 is composed a pin 9*a* only and the head portion thereof has a taper surface 9*e* formed such that the diameter of the head portion is increased toward the extreme end thereof as compared with the portion thereof corresponding to the inclined surface 5*b* of an inner rotor 5. Further, an inclined surface 9*f* is formed to the head portion which extends from an end in a recess 7 located forward of the rotational direction of the inner rotor 5 toward rearward of the rotational direction. In this case, a navel 6 is also moved from the thread piecing position to the ordinary spinning position in the state that the thread Y is spun without passing through a thread guide 8 as well as when the rotational speed of the inner rotor 5 is made slower than a moving speed at a taking-off point, the thread Y rotatingly moves on an end surface 5*a* and then is introduced into the spinning position in the thread guide 8 by being guided by the taper surface 9*e*.

The existence of the taper surface 9f prevents the possibility that the thread Y is caught by the pin 9a and broken even if the thread Y relatively moves rearward of the rotational direction of the inner rotor 5 in the state that the thread Y is spun without passing through the thread guide 8.

Figure 12C:
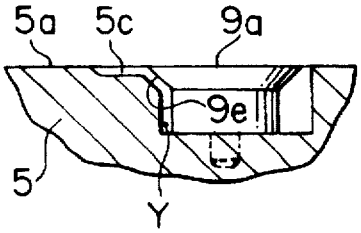
FIG. 12C and FIG. 12D are cross-sectional views of additional modifications.

(3) A guide member 9 may be disposed in the state that the end surface thereof is located on the same plane as the end surface 5a of an inner rotor 5 or it is recessed therefrom. For example, as shown in FIG. 12C, a pin 9a having a taper surface 9e is attached so that the end surface thereof is located on the same plane as the end surface 5a. The end surface 5a has a guide recess 5c formed thereto which is located at a position rearward of the rotational direction of the inner rotor 5 with respect to the pin 9a. In this case, the thread Y is introduced into a thread guide 8 by being guided by the taper surface 9e of the pin 9a substantially similarly to the item (2). Further, since there is no possibility that the thread Y is caught by the pin 9a even if the thread Y rotatingly moves rearward of the rotational direction of the inner rotor 5, an inclined surface 9f need not be formed to the pin 9a, thus the pin 9a can be easily made.

Figure 12D:
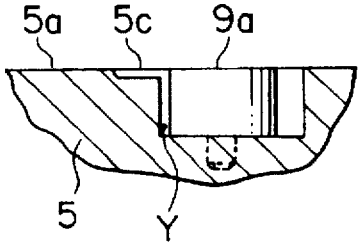
Figure 13A:
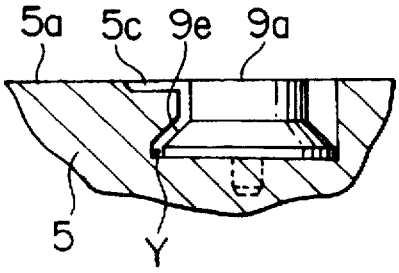
FIG. 13A and FIG. 13B are cross sectional views of another modification corresponding to FIG. 12B.
Figure 13B:
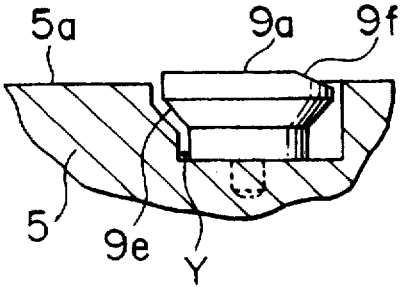
Figure 14:
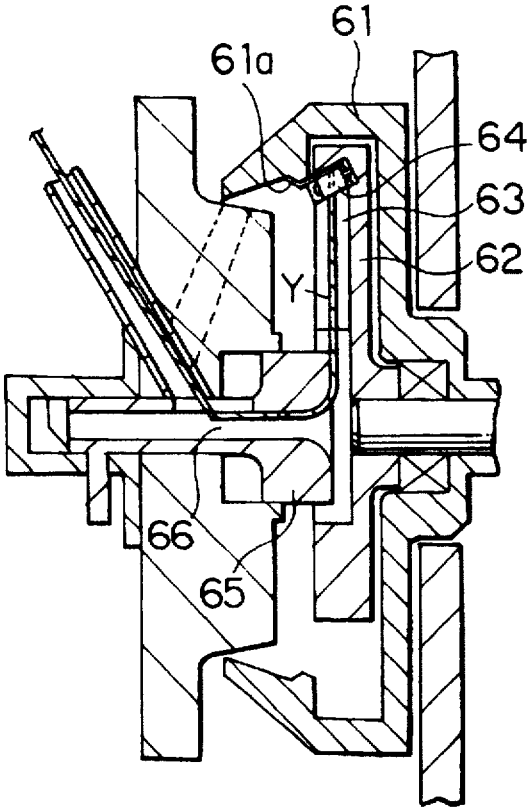
FIG. 14 (PRIOR ART)
FIG. 14 is a cross sectional view of a conventional apparatus.
Figure 15:
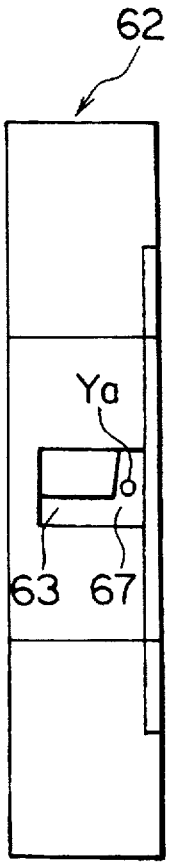
FIG. 15 (PRIOR ART)
FIG. 15 is a side elevational view of the inner rotor of the conventional apparatus.

(4) A pin 9a having the same diameter up to the extreme end thereof may be used as shown in FIG. 12D or a pin 9a having a taper surface 9e for causing the bottom thereof to have a larger diameter may be used as shown in FIG. 13A. Further, a pin 9a to which a taper surface 9e is formed at the intermediate portion thereof to increase the diameter of the extreme end of the pin may be used as shown in FIG. 13B.

(5) A guide member 9 is not formed separately from an inner rotor 5 but the portion thereof having a shape corresponding to a pin 9a formed to one of the above respective shapes may be formed integrally with the inner rotor 5.

(6) An arm 27 may directly press a lever 14 by the omission of a leaf spring 17 constituting the moving means of a navel 6.

(7) An operating member may be disposed on a spinning unit 24 side to move a navel 6 to an retracted position by pressing a leaf spring 17 or a lever 14 when a thread is pieced. For example, an air cylinder or the like is disposed at such a position that when the piston rod thereof is projected, it is engaged with the leaf spring 17 or the lever 14 to thereby move the navel 6 to a thread piecing position. A switch for operating the air cylinder is disposed to the outside of the spinning unit 24. The thread piecing apparatus 26 moves the navel 6 to the thread piecing position and an ordinary spinning position through an arm 27 by operating the switch. In this arrangement, the operator can also easily piece a thread by operating the switch.

(8) A device disclosed in Japanese Unexamined Patent Publication No. 6-123020 may be employed as a means for moving a navel 6. That is, the cylindrical portion 6a of the navel 6 is inserted into a cylindrical support member 12 having a guide hole and an engaging portion passing through the guide hole is projected from the outer surface of the base end of the cylindrical portion 6a and when the engaging portion is rotated on the cylindrical portion 6a by a rotary solenoid, the navel 6 is moved in an axial direction. The switch of the rotary solenoid is disposed to the outside of a spinning unit 24. The thread piecing apparatus 26 is arranged such that the navel 6 is moved to a thread piecing position and an ordinary position by operating the switch. The operator can piece a thread through an arm 27 by operating the switch also in this case.

(9) A spring such as a leaf spring or the like may be used as an urging means for urging a navel 6 to an ordinary spinning position.

(10) An air hole for communicating the bottom of the fiber bundling portion 2a of an outer rotor 2 with the outer periphery of the outer rotor 5 may be formed. Since there is generated an air flow from the inside of the outer rotor 2 toward the outer periphery thereof through the air hole in this case, a force acts to press a fiber bundle F bundled to the fiber bundling unit 2 to the bottom thereof, so that twist is difficult to be transmitted to a fiber bundle in the fiber bundling portion 2a.

(11) A self-exhausting hole may be formed to an outer rotor 2.

Inventions which can be achieved from the above embodiment and modifications other than those disclosed in claims will be described below together with their advantages.

A lever has a leaf spring secured thereto and an operating means is engaged with the leaf spring and transmits a pressure to the lever. In this case, even if the stroke of the operating means is not accurately set, the application of an unreasonable force to the lever and the like can be prevented.

What is claimed is:

1. A thread piecing method in an open end spinning frame having a cup-shaped outer rotor having an axis, a bottom wall centered on said axis, and a cylindrical side wall radially spaced from and concentric with said axis, wherein said side wall extends from said bottom wall to an open mouth of the rotor and has formed therein a fiber collecting portion which lies in a plane perpendicular to said axis, fibers in a separated state upon being fed to said side wall being collected by said fiber collecting portion, and an inner rotor disposed coaxially within said outer rotor, said inner rotor containing a radially extending thread guide for guiding fibers withdrawn from said fiber collecting portion to an entrance to a thread drawing-out path, wherein the inner rotor has a face facing said mouth of the outer rotor and is positively driven independently of the outer rotor to piece the thread by moving a navel disposed at said entrance of the thread drawing-out path from an ordinary spinning position to a thread piecing position nearer to said mouth of the outer rotor, and thereafter returning said navel to said ordinary spinning position, comprising the steps of:

forming said thread guide in said inner rotor as a channel extending radially along said face of said inner rotor from a first open end at the periphery of said inner rotor toward a second open end spaced from the axis of the inner rotor;

moving said navel to said thread piecing position where the plane coinciding with the end of the navel facing said inner rotor is located within said outer rotor but spaced from the plane of said face of said inner rotor for piecing the thread;

introducing a seed thread from said drawing-out path into said outer rotor through the space between said navel and said inner rotor while said outer rotor is rotating;

feeding said seed thread until the leading end thereof reaches a fiber bundle of the fed fibers in said fiber collecting portion of said outer rotor;

spinning said fiber bundle with said seed thread while drawing them without entering said inner rotor thread guide from said outer rotor into said drawing-out path;

thereafter moving said navel to said ordinary spinning position thereby urging the spinning fibers against said face of said inner rotor while controlling the withdrawing speed and the rotor speeds to move said spinning fibers relative to said inner rotor until guides provided with said channel engage said spinning fibers and guide them into said channel; and proceeding with ordinary spinning while holding said navel at said ordinary spinning position.

2. A thread piecing method according to claim 1, wherein said inner and outer rotors are rotated at slower speeds than the speeds used during ordinary spinning while performing said introducing and feeding of said seed thread; and the rotation speeds of said inner and outer rotors are increased to ordinary spinning speeds before moving said navel to said ordinary spinning position.

3. A thread piecing method according to claim 1, wherein said step of spinning said fiber bundle with said seed thread while drawing them without entering said inner rotor thread guide is carried out by establishing the relative speed of rotation of said inner rotor with respect to said withdrawing speed such that said inner rotor is moving in a direction relative to said fiber bundle and said seed thread that prevents said guides from guiding said fibers into said channel; and said step of moving said spinning fibers into said channel is carried out after said rotors-are rotating at ordinary spinning speeds by changing said relative speed to reverse the direction of relative movement of said inner rotor with respect to said fiber bundle until said guides guide said fiber bundle into said channel.

4. A thread piecing method according to claim 3, wherein said relative speed is changed by changing the rotational speed of said inner rotor.

5. A thread piecing method according to claim 3, wherein said relative speed is changed by changing the speed at which the fiber bundle is drawn out.

6. A thread piecing method according to claim 3, wherein said guides are disposed in the vicinity of an inlet of said channel shaped to permit relative movement of the spinning fiber bundle across said inlet in the direction opposite the rotational direction of said inner rotor without entering said channel, and to guide said spinning fiber bundle into said channel when the relative movement of said fiber bundle is in the same direction as the rotational direction of said inner rotor; said spinning of said thread being conducted while rotating said inner rotor at a faster speed than the speed at which the fiber bundle is being withdrawn during thread piecing thereby preventing said fiber bundle from entering said channel; and after said inner rotor reaches said ordinary spinning speed reducing the rotational speed of said inner rotor to introduce said fiber bundle into said channel.

7. A thread piecing method according to claim 6, wherein when it is assumed that the inside diameter of said outer rotor (2) in said fiber collecting portion (2*a*) is D, the rotational speed of said outer rotor (2) is $R_1$, the rotational speed of said inner rotor (5) is $R_2$ and a spinning speed is V, said outer and inner rotors are driven to satisfy the relations $\pi DR_2 > \pi DR_1 + V$, when the thread is pieced and $\pi DR_2 < \pi DR_1 + V$, in the ordinary spinning.

8. A thread piecing method according to claim 3, wherein said guides are disposed in the vicinity of an inlet of said channel shaped to permit relative movement of the spinning fiber bundle across said inlet in the direction opposite the rotational direction of said inner rotor without entering said channel, and to guide said spinning fiber bundle into said channel when the relative movement of said fiber bundle is in the same direction as the rotational direction of said inner rotor; said spinning of said thread being conducted while rotating said inner rotor at a slower speed than the speed at which the fiber bundle is being withdrawn during thread piecing thereby preventing said fiber bundle from entering said channel; and after said inner rotor reaches said ordinary spinning speed increasing the rotational speed of said inner rotor to introduce said fiber bundle into said channel.

9. A thread piecing method according to claim 8, wherein when it is assumed that the inside diameter of said outer rotor (2) in said fiber collecting portion (2*a*) is D, the rotational speed of said outer rotor (2) is $R_1$, the rotational speed of said inner rotor (5) is $R_2$ and a spinning speed is V, said outer rotor and said inner rotor are driven to satisfy the relations $\pi DR_2 < \pi DR_1 + V$, in the accelerated state of said inner rotor and said outer rotor when the thread is pieced, $\pi DR_2 > \pi DR_1 + V$, after the ordinary rotational speed is achieved, and $\pi DR_2 < \pi DR_1 + V$, during ordinary spinning.

10. A thread piecing apparatus for an open end spinning frame comprising a cup-shaped outer rotor having an axis, a bottom wall centered on said axis, and a cylindrical side wall radially spaced from and concentric with said axis, wherein said side wall extends from said bottom wall to an open mouth of the rotor and has formed therein a fiber collecting portion centered axially about a plane perpendicular to said axis and which bundles fibers fed to it in a separated state;

a thread drawing-out passage disposed coaxially with said axis and having an entrance facing said outer rotor;

an inner rotor disposed coaxially within said outer rotor, said inner rotor containing a radially extending thread guide for guiding fibers withdrawn from said fiber collecting portion to said entrance to said thread drawing-out passage and having a face facing said mouth of the outer rotor;

means coupled thereto for positively driving said inner and outer rotors independently of each other;

a navel disposed at said entrance of said thread drawing-out passage coaxial with said axis and having an end facing said inner rotor, said navel being movable axially along said axis between an ordinary spinning position and a thread piecing position, in both of said navel positions said end of said navel being located within said outer rotor but in said thread piecing position it is spaced axially from said face of said inner rotor nearer to said mouth of the outer rotor than in said ordinary spinning position;

means coupled thereto for moving said navel between said two positions;

a recess formed in said face of said inner rotor centered about said axis for receiving said navel when said navel is moved to said ordinary spinning position;

said inner rotor thread guide comprising a channel extending radially along said face of said inner rotor from a first open end at the periphery of said inner rotor toward a second open end communicating with said recess; and a plurality of guide surfaces formed along said face of said inner rotor adjacent lips of said channel and on a guide means disposed in said channel, said guide surfaces being formed to guide spinning fibers into said channel upon movement of said fibers relative to said face of said inner rotor in a first direction transverse to said channel and to inhibit movement into said channel for reverse relative movement.

11. A thread piecing apparatus according to claim 10, wherein said recess (7) has a tapered surface (7*a*) formed on the peripheral edge thereof.

12. A thread piecing apparatus according to claim 11, wherein said means (12–17) for moving said navel are arranged so as to be operated by a movable thread piecing apparatus (26) moving along a frame base (25) of an open end spinning frame including a plurality of spinning units (24).

13. A thread piecing apparatus according to claim 11, wherein said guide surfaces include a guide recess (5c) located at the trailing lip of said channel with regard to the direction of rotation of said inner rotor and communicates with said channel.

14. A thread piecing apparatus according to claim 10, wherein said means (12–17) for moving said navel are arranged so as to be operated by a movable thread piecing apparatus (26) moving along a frame base (25) of an open end spinning frame including a plurality of spinning units (24).

15. A thread piecing apparatus according to claim 14, wherein said means (12–17) for moving said navel includes a support member (12) for supporting said navel (6), a lever (14) extending in a direction perpendicular to said support member (12) and having a first end engaged with said support member (12), urging means (16) for urging said lever (14) in a direction for holding said navel (6) at said ordinary spinning position, and said movable thread piecing apparatus (26) includes operating means (27) for pressing said lever (14) against said urging means (16).

16. A thread piecing apparatus according to claim 15, wherein said urging means is a coil spring (16) and said operating means is a leaf spring (27).

17. A thread piecing apparatus for an open end spinning frame according to claim 10, wherein means for preventing the passage of short fibers is disposed between the inner surface of said outer rotor and the outer surface of said inner rotor at a position nearer to said bottom wall of said outer rotor as compared with said fiber collecting portion.

18. A thread piecing apparatus according to claim 17, wherein said prevention means is composed of an annular projecting step portion formed on the inner periphery of said cylindrical wall, and an annular complementary step portion formed on the outer periphery of said inner rotor.

19. A thread piecing apparatus according to claim 18, wherein said prevention means is a labyrinth seal disposed between the inner surface of said cylindrical side wall of said outer rotor and the outer surface of the periphery of said inner rotor.

20. A thread piecing apparatus according to claim 10, wherein said guide surfaces include a guide recess (5c) located at the trailing lip of said channel with regard to the direction of rotation of said inner rotor and communicates with said channel.

21. A thread piecing apparatus according to claim 20, wherein said means (12–17) for moving said navel are arranged so as to be operated by a movable thread piecing apparatus (26) moving along a frame base (25) of an open end spinning frame including a plurality of spinning units (24).

22. A thread piecing apparatus according to claim 18, wherein said guide means disposed in said channel is a guide unit (9) on which one of said guide surfaces is formed; and which further comprises means (42) for detecting the speed of rotation of said outer rotor (2) and providing an output signal proportional to said detected speed, arithmetic operation means (34) coupled to said speed detecting means for calculating the rotational speed of said outer rotor (2) based on said signal, and control means (33, 34) coupled thereto for controlling said rotor driving means (M, 45) so that said outer rotor and said inner rotor achieve predetermined rotational speeds.

23. A thread piecing apparatus according to claim 22, wherein said guide unit (9) is a guide member composed of a pin having a diameter larger than the diameter of a thread and a guide piece attached to the extreme end of said pin, where the end surface of said guide piece projects from said face of said inner rotor.

24. A thread piecing apparatus according to claim 22, wherein said guide unit (9) is formed integrally with said inner rotor.

25. A thread piecing apparatus according to claim 22, wherein said guide unit (9) is formed separately from said inner rotor.

26. A thread piecing apparatus according to claim 22, wherein said guide unit (9) has a base secured to the bottom of said channel (8), and extends up from said base to an upper surface at least as high as said face of said inner rotor for guiding said relatively moving fibers across the mouth of said channel, the shape and surfaces of said guide unit (9) being constructed to guide said fibers into said channel for only one direction of relative movement between said inner rotor and said fibers.

27. A thread piecing apparatus according to claims 22, wherein said guide unit (9) is composed of a pin having a head portion, said head portion being formed with a tapered surface (9e) increasing the diameter of the head portion toward the top of said head portion on the side of said head portion that faces in the direction opposite to the direction of rotation of said inner rotor, and an inclined surface (9f) on the opposite side of said head portion inclined in the same direction as said tapered surface.

28. A thread piecing apparatus according to claim 22, wherein said guide unit (9) is composed of a pin having a head portion, said head portion having a top surface and a tapered surface (9e), the latter having a diameter increasing toward said top surface, and said top surface is located in the same plane as said face (5a) of said inner rotor.

29. A thread piecing apparatus according to claim 22, wherein said guide unit (9) is composed of a pin having a constant diameter from a base end located in said channel to an opposite end located in the same plane as said face of said inner rotor.

30. A thread piecing apparatus according to claim 22, wherein said guide unit (9) is composed of a pin having a head portion, said head portion having a tapered surface (9e), a top surface, and a bottom, said top surface being located in the same plane as said face of said inner rotor, and said tapered surface increasing in diameter toward said bottom corresponding to an inclined surface formed in said inner rotor.

31. A thread piecing apparatus according to claim 22, wherein said guide unit (9) is composed of a pin having a head portion, said head portion having a tapered surface (9e), a top, and a bottom, said tapered surface increasing in diameter toward said bottom corresponding to an inclined surface formed in said inner rotor, and an inclined surface (9f) on the side of said head portion facing in the direction of rotation of said inner rotor and extending toward the top of said head portion from a forward location relative to said direction of rotation of said inner rotor to a rearward location relative to said direction of rotation.

* * * * *

UNITED STATES PATENT AND TRADEMARK OFFICE

CERTIFICATE OF CORRECTION

PATENT NO. : 5,787,699

DATED : August 4, 1998

INVENTOR(S) : MORISHITA et al.

It is certified that error appears in the above-identified patent and that said Letters Patent is hereby corrected as shown below:

Column 1, line 54, change " also-arises" to --also arises--.

Column 2, line 31, after " 61a" insert a comma --,--.

Column 7, line 45, after " shaft 1" insert a comma --,--;

line 56, change " or" to --on-;

line 61, change " that" to --the--.

UNITED STATES PATENT AND TRADEMARK OFFICE

CERTIFICATE OF CORRECTION

PATENT NO. : 5,787,699

DATED : August 4, 1998

INVENTOR(S) : MORISHITA et al.

It is certified that error appears in the above-identified patent and that said Letters Patent is hereby corrected as shown below:

Column 9, line 48, change " are" to --is--;

line 60, delete " advances" .

Column 10, line 34, after " 6c" insert --is--;

line 52, after " returns" insert --to--;

line 59, after " pressed" insert --by--.

Column 17, line 21, change " rotors-are" to --rotors are--;

line 54, change " in the" to --during--.

Signed and Sealed this

Twenty-third Day of February, 1999

*Attest:*

Q. TODD DICKINSON

*Attesting Officer*

*Acting Commissioner of Patents and Trademarks*